United States Patent [19]

Maros

[11] Patent Number: 4,492,815

[45] Date of Patent: Jan. 8, 1985

[54] SHIELDED JACKETED FLAT CABLE AND GROUNDING CLIP FOR USE THEREWITH

[75] Inventor: Ronald R. Maros, Itasca, Ill.

[73] Assignee: Cooper Industries, Inc., Houston, Tex.

[21] Appl. No.: 525,643

[22] Filed: Aug. 23, 1983

[51] Int. Cl.[3] ..... H01B 7/08; H01R 4/24

[52] U.S. Cl. ..... 174/78; 174/36; 174/84 C; 174/115; 174/117 F

[58] Field of Search ..... 174/36, 78, 84 C, 115, 174/117 F

[56] References Cited

U.S. PATENT DOCUMENTS

| | | | |
|---|---|---|---|
| 3,753,213 | 8/1973 | Frey | 174/78 X |
| 3,880,488 | 4/1975 | Collier et al. | 174/84 C X |
| 3,934,075 | 1/1976 | Dilliplane | 174/36 X |
| 4,248,493 | 2/1981 | Kuo | 174/84 C X |
| 4,256,359 | 3/1981 | Storck | 174/78 X |

FOREIGN PATENT DOCUMENTS

| | | | |
|---|---|---|---|
| 17077 | 10/1980 | European Pat. Off. | 174/36 |

*Primary Examiner*—John F. Gonzales
*Assistant Examiner*—Morris H. Nimmo
*Attorney, Agent, or Firm*—Fitch, Even, Tabin & Flannery

[57] ABSTRACT

The combination of a metallic grounding clip and a shielded, jacketed flat cable of the type including a main portion having a plurality of spaced signal conductors, an offset portion including a drain wire, and a metallic shield which encompasses the signal conductors and extends into the offset portion in contact with the drain wire. The clip has a first leg, a second leg, and a web joining the legs and defining therewith a channel for receiving the offset portion. At least one of the legs has a termination member for piercing the offset portion to contact the drain wire. Thus the clip can be attached to the cable remote from the signal conductors at any desired location along the length of the cable and the shield of the cable can extend to the cable ends.

10 Claims, 5 Drawing Figures

SHIELDED JACKETED FLAT CABLE AND GROUNDING CLIP FOR USE THEREWITH

BACKGROUND OF THE INVENTION

The present invention relates to grounding terminations for shielded cables and, more particularly, to a metallic grounding clip for use with a shielded, jacketed flat cable.

The use of flat cables for interconnecting components of electrical and electronic equipment has been rapidly increasing. Flat cable allows high density wiring, offers a neat appearance, and is conducive to use with labor saving mass termination insulation displacement connectors. It is sometimes necessary to shield the signal conductors in the flat cable from stray voltages or current induced by electrical fields by surrounding the conductors with a metal foil or braid connected to ground.

Typically, the shield is grounded by stripping away an end portion of the outer jacket of the cable, folding the exposed portion of the shield back over the jacket and bolting together a pair of metallic blocks with the exposed shield positioned therebetween. It will be appreciated that this grounding method is time consuming and operator judgment is required regarding the degree of tightening of the blocks. Inadequate tightening results in poor electrical contact between the blocks and the shield while excessive tightening of the blocks beyond the elastic limits of the jacket material and other insulation could result in short circuiting of the conductors. Additionally, this grounding method relies on the resiliency of the jacket and insulation to maintain firm contact between the blocks and shield. With age, the plastic material between the blocks loses its resiliency and takes a permanent set thereby degrading the contact between the foil and the blocks.

SUMMARY OF THE INVENTION

Among the several objects of the invention may be noted the provision of an improved shielded flat cable and grounding clip for use therewith; the provision of such cable and clip which permits grounding of the shield remote from the signal conductors; the provision of such clip which compressively holds the drain wire connected to the shield; the provision of such cable and clip which permits grounding at any desired location along the length of the cable, allows the shield to extend to the end of the cable, and avoids the time consuming steps of stripping away the jacket end and folding back the shield; and the provision of such cable and clip which is fast and simple in application, has long service life, and is economical to manufacture. Other objects and features of the present invention will be in part apparent and in part pointed out hereinafter in the specification and attendant claims.

Briefly, the clip of the present invention, for use with a shielded, jacketed flat cable having a main portion and an offset portion including a drain wire, comprises a first leg, a second leg, and a web joining the legs and defining therewith a channel for receiving the offset portion. At least one of the legs has termination means for piercing the offset portion to contact the drain wire. The clip can be attached to the cable, remote from the signal conductors, at any desired location along its length. This allows the shield of the cable to extend to the cable ends.

BRIEF DESCRIPTION OF THE DRAWINGS

Corresponding reference characters indicate corresponding parts throughout the several views of the drawings.

DESCRIPTION OF THE PREFERRED EMBODIMENT

Figure 3:
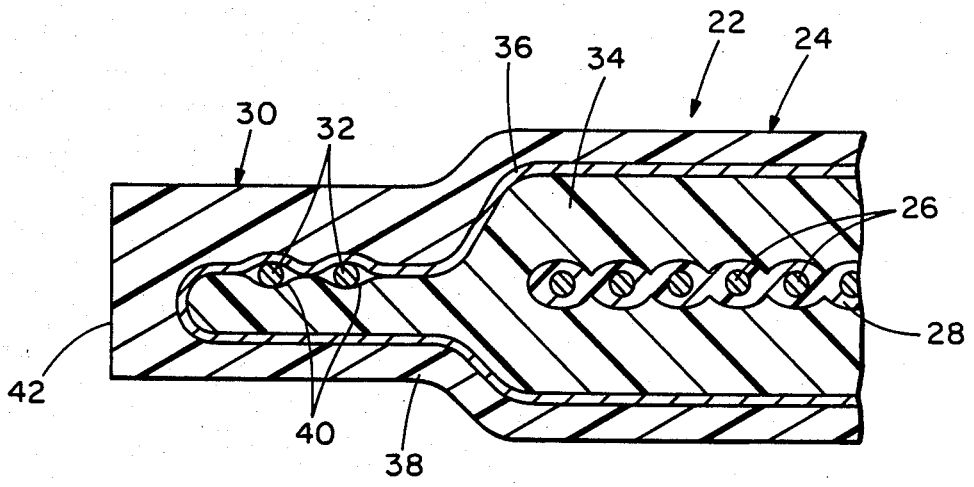
FIG. 3 is a partial sectional view of the shielded flat cable of the present invention.
Figure 5:
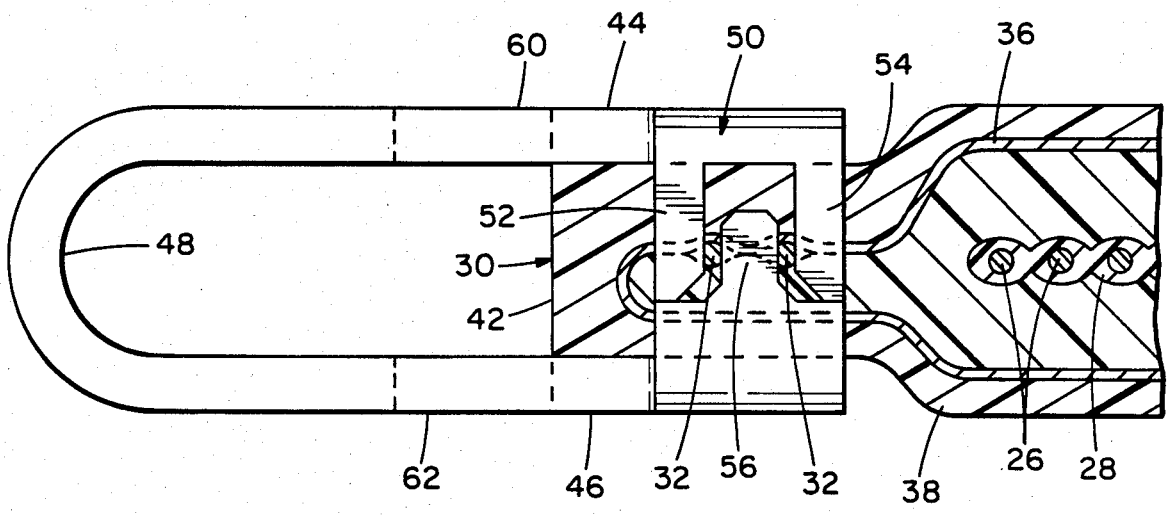
FIG. 5, similar to FIG. 3, illustrates the completed application of the clip to the cable.

Referring now to the drawings, a grounding clip for use in connecting the drain wire of a jacketed, shielded flat cable to ground, such as the through the chassis of a piece of electrical equipment, is generally indicated by reference numeral 20. A shielded, jacketed flat cable 22, best shown in FIGS. 3 and 5, is for use with clip 20. Cable 22 comprises a main portion 24 including a plurality of parallel, regularly spaced and generally coplanar signal conductors 26 held in an inner insulative jacket 28 made of a tough plastic material such as polyvinyl chloride. The cable also comprises an offset portion 30 including one or more drain wires 32. An insulative layer 34, preferably formed of polyethylene, encompasses signal conductors 26 and extends into offset portion 28. A metallic shield 36, formed of foil or braid, is disposed about the periphery of layer 34 to surround signal conductors 26 and contact drain wires 32. The cable 22 also includes an outer insulative jacket 38 again preferably made of a tough plastic material such as polyvinyl chloride for mechanical protection. The periphery of insulative layer 34 has grooves 40 for seating the drain wires in electrical contact with shield 36, to maintain the drain wires at substantially constant distances from the distal side 42 of offset cable portion 30 throughout the length of the flat cable 22.

Figure 1:
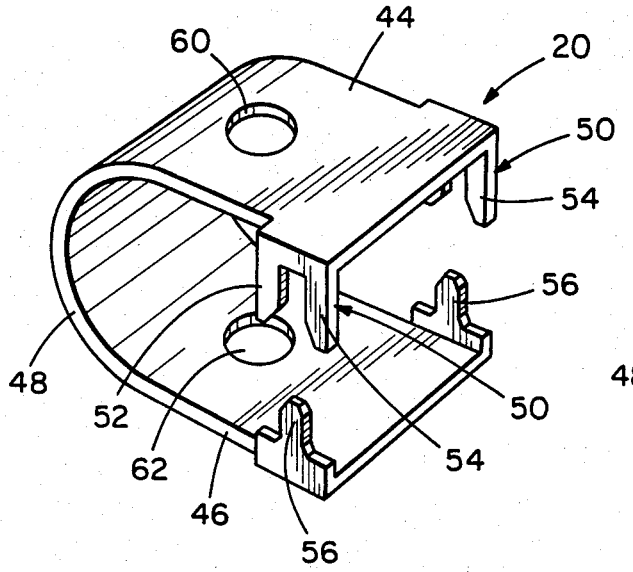
FIG. 1 is a perspective view of the grounding clip of the present invention.
Figure 2:
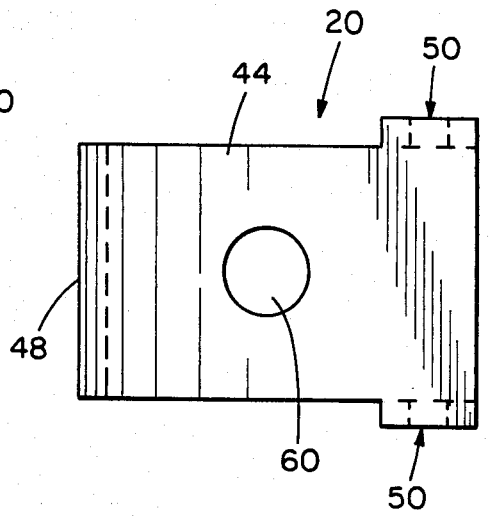
FIG. 2 is a plan of the clip of FIG. 1.

Grounding clip 20 is of deformable metallic construction and is preferably made of a copper alloy. The clip is preferably formed by bending components of a flat blank. The clip comprises a first leg 44, a second leg 46 and a web 48 joining the legs and defining therewith a channel for receiving the offset cable portion 30. At least one of the legs includes termination means for piercing offset portion 30 to effect contact with the drain wires 32. More specifically, both legs carry such termination means. First leg 44 has termination means in the form of a socket 50 constituted, in part, by first and second dependent arms 52, 54, respectively. The termination means of second leg 46 is in the form of a plug 56 for reception between the arms of the socket. As shown in FIG. 1, first leg 44 has a pair of sockets 50 while second leg 46 has a pair of corresponding plugs 56.

Referring to FIG. 5, application of the clip 20 to cable 22 causes one drain wire to be compressively held between plug 56 and first arm 52 while the other drain wire is compressively held between the plug and second arm 54. The plug and the arms are provided with inclined guide surfaces for directing the drain wires to their positions during application of the clip to the cable resulting in the clip contacting the drain wires in four locations to insure effective grounding of the shield. The base of the plug has abutment surfaces 58 for engaging the free ends of socket arms 52, 54 to limit movement of legs 44, 46 toward one another so that, after application, the plastic insulation between the legs is not substantially compressed. Such compression could result in the legs being moved apart. Offset portion 30 is preferably centered with respect to main cable portion 24. The combined thicknesses of first leg 44, second leg 46 and offset portion 30 is preferably substantially equal to the thickness of the main cable portion whereby, after application, surfaces of clip 20 are generally coplanar with surfaces of the main cable portion to present a better appearance and to avoid the ground cable from intefering with other objects.

Figure 4:
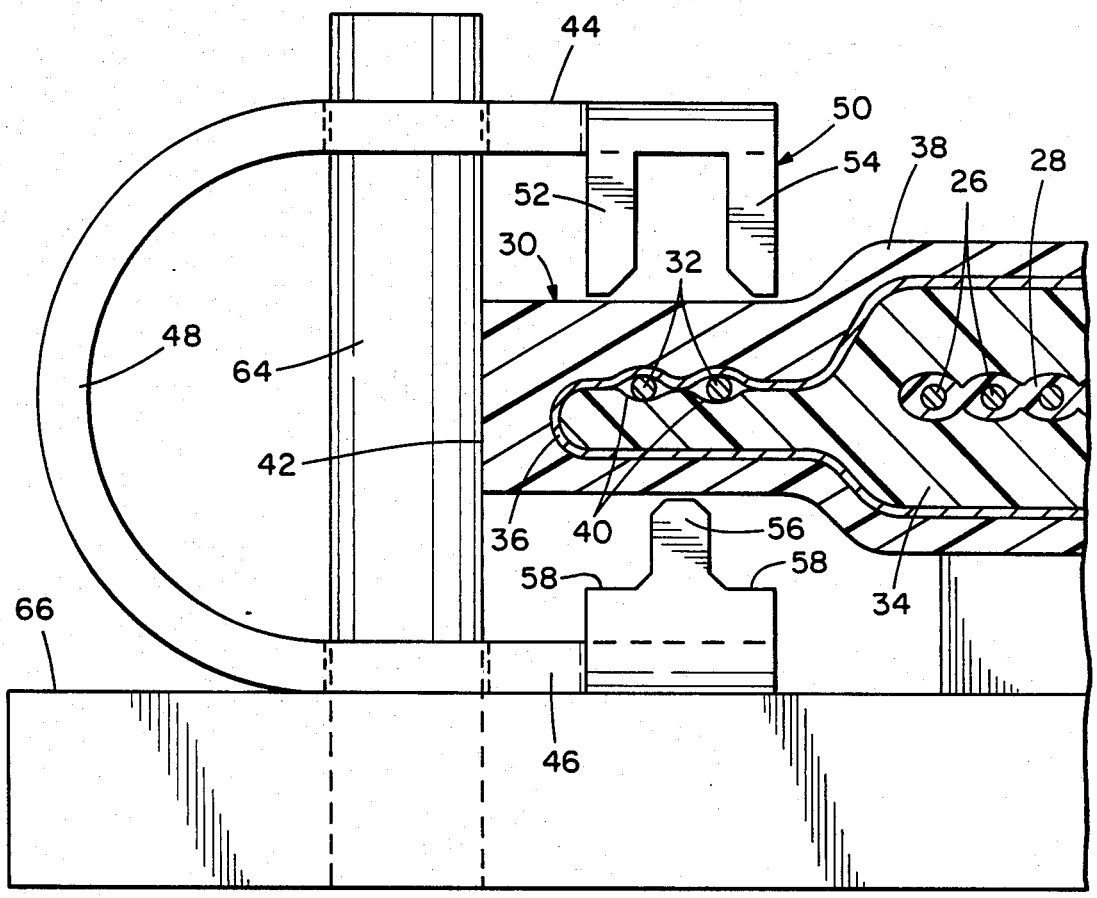
FIG. 4 shows the clip and cable disposed on a fixture for use in applying the clip to the cable.

First leg 44 and second leg 46 have aligned apertures 60, 62, respectively, for receivng an alignment pin 64 (see FIG. 4) extending from a termination tooling bed 66. The distance between apertures 60, 62 and the termination means (the plug and socket) corresponds to the distance between distal side 42 and drain wires 32. More specifically, the distance between the innermost portion of the surface defining one of the apertures to the center line of plug 56 is substantially equal to the distance between distal side 42 and the midpoint between the drain wires. Besides aligning the plug and socket with the drain wires, the presence of pin 64 in apertures 60, 62 restrains legs 44, 46 from relative lateral movement during clip application which can be effected by using a bench press to apply force against first leg 44 to move it toward tooling bed 66.

Operation of clip 20 and cable 22 of the present invention are as follows: The operator places clip 20 on tooling bed 66 with pin 64 extending through the apertures in first leg 44 and second leg 46. Offset portion 30 of cable 22 is inserted between socket 50 and plug 56 until distal side 42 engages the pin to align the drain wires 32 for termination. Operation of the bench press causes relative movement of legs 44, 46 toward one another resulting in arms 52, 54 of socket 50 piercing offset portion 30 and plug 56 also piercing the offset portion and moving between the arms. Due to their alignment and the presence of the guide surfaces on the plug and arms, one drain wire becomes positioned between the plug and first arm 52 while the other drain wire becomes disposed between the plug and second arm 54. As the plug and socket engage the drain wires compressively and with wiping action, any oxides on the surface of the drain wires are removed and the drain wires are slightly deformed to make good contact with the clip at four locations for each plug-socket pair.

As the legs are moved together, web 48 is inelastically deformed which, along with the compressive forces among the drains wires, plug and socket, maintains clip 20 in its applied condition. After removal of the completed termination from the termination tooling, apertures 60, 62 are useful for receiving a threaded fastener to connect the clip to an equipment chassis or a grounding strap.

The clip and cable of the present invention offer several improvements over prior art shielded cables and connectors. As the connection to the drain wire is remote from the signal conductors, they cannot be damaged by application of the clip. The clip can be applied at any desired location along the length of the cable and, since the shield does not have to be bent back at the cable end, the shield can run the entire length of the cable to fully protect from induced voltages. The clip can be quickly and easily installed without stripping away insulation from the flat cable. Should the clip be improperly or erroneously installed, it is a simple matter to remove it using a simple tool, such as a screwdriver, to spread the legs to effect release.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. The combination of a metallic grounding clip and a shielded, jacketed flat cable of the type comprising a main portion having a plurality of spaced signal conductors, an offset portion joined to said main portion and including a drain wire spaced from a distal side of said offset portion, and a metallic shield which encompasses said signal conductors and extends into said offset portion in contact with said drain wire, said clip comprising:

a first leg;

a second leg; and a web joining said legs and defining therewith a channel receiving said offset portion, at least one of said legs comprising a termination means piercing said offset portion to contact said drain wire whereby said clip can be attached to said cable, remote from said signal conductors, at any desired location along its length and the shield of said cable can extend to the cable ends.

2. The combination as set forth in claim 1 wherein each of said legs carry said termination means piercing said offset portion, the two termination means compressively holding said drain wire therebetween.

3. The combination as set forth in claim 2 wherein one of the termination means is in the form of a plug and the other termination means is in the form of a socket receiving said plug.

4. The combination as set forth in claim 3 wherein said cable comprises a pair of spaced drain wires each contacting said shield, said socket comprising a first arm and a second arm with one drain wire held between said plug and said first arm and other drain wire held between said plug and said second arm whereby said clip contacts said drain wires at four locations.

5. The combination as set forth in claim 4 wherein said plug and said socket comprise guide surfaces for directing said drain wires to their above-described positions during application of said clip to said cable.

6. The combination as set forth in claim 1 wherein said clip is one-piece construction and is formed from a blank made of a copper alloy.

7. The combination as set forth in claim 1 wherein said first and second legs have aligned apertures for receiving a pin, the distance between said apertures and said termination means corresponding to the distance between the distal side of said offset portion and said drain wire whereby, with said pin extending through said apertures and against said distal side, said termination means is in alignment with said drain wire, and during application, said pin restrains said legs from relative lateral movement.

8. The combination as set forth in claim 1 wherein said offset cable portion is centered witn respect to said main portion and wherein the combined thickness as of said first leg, said second leg and said offset cable portion are substantially equal to the thickness of said main cable portion so that, after application, surfaces of said clip are generally coplanar with surfaces of said main cable portion.

9. A shielded, jacketed flat cable comprising:

a main portion including a plurality of spaced signal conductors;

an offset portion including a drain wire;

a metallic shield encompassing said signal conductors and extending into said offset portion in contact with said drain wire; and means for holding said drain wire a substantially constant distance, throughout the length of said cable, from the distal side of said offset portion whereby the drain wire can be terminated at any desired location along the length of said cable, without interference from said signal conductors, by using the distal side as a reference to locate said drain wire.

10. A cable as set forth in claim 9 wherein said holding means comprises a layer of insulation encompassing said signal conductors and extending into said offset portion, said layer having groove means for seating said drain wire.

* * * * *